US006849103B2

(12) United States Patent
Kim

(10) Patent No.: US 6,849,103 B2
(45) Date of Patent: Feb. 1, 2005

(54) RAPIDLY EXPANDING METALLIC MIXTURE TREATED TO PREVENT OXIDATION THEREOF AT ROOM TEMPERATURE

(75) Inventor: Chang Sun Kim, 358-7 Namchon-dong, Namdong-gu, Incheon-shi 405-100 (KR)

(73) Assignee: Chang Sun Kim, Icheon (KR)

( * ) Notice: Subject to any disclaimer, the term of this patent is extended or adjusted under 35 U.S.C. 154(b) by 139 days.

(21) Appl. No.: 10/278,839

(22) Filed: Oct. 24, 2002

(65) Prior Publication Data

US 2003/0084753 A1 May 8, 2003

(30) Foreign Application Priority Data

Nov. 5, 2001 (KR) ..... 2001-0068546

(51) Int. Cl.[7] ..... B22F 1/00

(52) U.S. Cl. ..... 75/252; 149/5; 149/6; 149/7; 149/37

(58) Field of Search ..... 75/252; 149/5, 149/6, 7, 37

(56) References Cited

U.S. PATENT DOCUMENTS 3,297,502 A * 1/1967 Chrisp ..... 149/6
3,793,099 A * 2/1974 Duerksen et al. ..... 149/19.4
3,926,698 A * 12/1975 Cook et al. ..... 149/44
3,951,068 A * 4/1976 Schroeder ..... 102/364
4,019,932 A * 4/1977 Schroeder ..... 149/19.1

* cited by examiner

*Primary Examiner*—Ngoclan T. Mai
(74) *Attorney, Agent, or Firm*—Staas & Halsey, LLP

(57) ABSTRACT

Disclosed is a rapidly expanding metallic mixture treated for oxidation prevention thereof at room temperature, comprising a metal salt and a metal powder, which prevents its spontaneous explosion due to oxidation of the metal powder in the mixture at room temperature during storage, or dysfunction of the mixture upon blasting work because of altered mixing ratios between the metal salt and the metal powder. The rapidly expanding metallic mixture is characterized in that the mixture is added with a water repellent such as oil or an inorganic preservative, or is coated with a resin and formed to the size of 0.1–100 $mm^3$.

4 Claims, No Drawings

RAPIDLY EXPANDING METALLIC MIXTURE TREATED TO PREVENT OXIDATION THEREOF AT ROOM TEMPERATURE

BACKGROUND OF THE INVENTION

1. Field of the Invention

The present invention concerns a rapidly expanding metallic mixture comprising a metal salt and a metal powder, which is treated to prevent oxidation thereof at room temperature and which thus prevents spontaneous explosion thereof due to oxidation of the metal powder at room temperature during storage, or dysfunction of the mixture upon blasting work because of improper mixing ratios between the metal salt and the metal powder.

2. Description of the Prior Art

The rapidly expanding metallic mixture was invented by the present inventors, and was patented by the Korean Intellectual Property Office (Korean Patent No. 10-0213577).

The rapidly expanding metallic mixture disclosed in Korean Patent No. 10-0213577 can be defined as follows.

In a mixture comprising a metal salt and a metal powder subjected to a high temperature of 700° C. or more (as such, the temperature to be applied varies with types and mixing ratios of the metal salt and the metal powder), while the metal salt oxidizes the metal powder, oxidation heat of ultrahigh temperatures (3,000–30,000° C.) is instantaneously created. When such a reaction is induced in a closed space, superhigh pressure of vapor expansion (40,000–60,000 kg/cm$^2$) is generated due to the oxidation heat. Immediately after such expansion, the reaction products shrink in volume. The present inventors confirmed the reaction results through repeated experiments involving the above reaction. In particular, the above reaction readily proceeds upon mixing of the metal salt and the light metal powder having relatively low melting points.

In this regard, when a mixture of ferrous nitrate ($Fe(NO_3)_2$) and manganese (Mn) powder is subjected to a thermal shock of about 1500° C., the following reaction occurs.

$$2Fe(NO_3)_3+12Mn \rightarrow 2FeO+4Mn_3O_4+3N_2$$

In the above reaction, oxidation heat of 10,000° C. or higher is created, by which iron (Fe) and manganese oxide ($Mn_3O_4$) products are vaporized and rapidly expanded. During vaporization and rapid expansion, a reverse reaction of the above reaction does not occur. When the volume of the reaction products increases larger by rapid expansion, internal temperature decreases. As such, iron (Fe) and manganese oxide ($Mn_3O_4$) are changed from gaseous state to solid state, and expansion pressure disappears instantaneously. A phenomenon of temperature decrease due to rapid expansion can be explained according to a Charles' Law related to volume and temperature, or the theory of adiabatic expansion.

Thus, the rapidly expanding metallic mixture is defined as a mixture comprising the metal salt acting as an oxidizing agent and the metal powder oxidized at high temperatures of 700° C. or more by the metal salt.

Upon oxidation, oxidation heat which is ultrahigh temperature heat of 3,000–30,000° C. is generated, by which vaporization and expansion of the reaction products occur, thus creating superhigh pressure of 40,000–60,000 kg/cm$^2$ in the closed space.

Such oxidation reaction and rapid expansion occurring only at high temperature conditions suggest industrial applicability of the metallic mixture. Hence, the metallic mixture can be substituted for conventionally used dynamite, thus being suitable for use in blasting rock masses in construction works. Compared to dynamite, the metallic mixture of the present invention is much higher in expansion force and shorter in a time period required for oxidation. In addition, immediately after the condition of high temperature is removed by rapid expansion, the vaporization-expanded product is changed to solid state and thus expansion reaction stops. Therefore, there is no scattering of the broken rock fragments, and explosive sound during rapid expansion is remarkably reduced. The reason why conventional gunpowder and the inventive metallic mixture have different effects is that conventional gunpowder employs oxidation and vaporization of organic materials, whereas the rapidly expanding metallic mixture of the present invention uses oxidation and vaporization of metals. In such conventional gunpowder, even though the internal temperature is decreased after rapid expansion, gas products are not changed again to solid state, but are diffused in gaseous state. So, conventional gunpowder suffers from the disadvantages in terms of scattering many fragments, and creating a loud explosive sound and large explosive vibration. Further, since typically used gunpowder may be ignited even at relatively low temperatures of about 250° C., it should be carefully handled during transport and storage. However, the inventive metallic mixture is advantageous in light of no possibility of accidental explosion during storage and handling of such materials due to the oxidation reaction being generated only at high temperatures which are not easily applied.

A mixing ratio of the metal salt and the metal powder is defined as a ratio of an oxygen amount generated from the metal salt and an oxygen amount required for oxidization of the metal powder, which is a ratio of molecular weights calculated from chemical formulas. The time period required for oxidation of the metal powder in a single capsule is a moment in the range of 1/2,000 to 1/100 sec.

The mixture of the metal salt and the metal powder is formulated in the form of a capsule and stored at room temperature. Even though the mixture is stored in a sealed state, the metal powder may be exposed to moisture or air by penetrating moisture or air into the mixture through connection of triggering devices. In such case, oxidation of the metal powder proceeds, which causes the following problems.

First, the rapidly expanding metallic mixture is not accidentally exploded by external impetus or impacts, but there is a possibility of triggering high temperature oxidation of the metallic mixture itself by oxidation heat created when the metal powder in the mixture is oxidized by moisture or air at room temperature. This is understood by the phenomenon of explosion of light metals such as magnesium upon contact with water at room temperature, with generating very high oxidation heat.

Second, during oxidation, an initial mixing ratio of the metal salt versus the metal powder is changed, and the oxidation reaction is not triggered at an expected oxidation temperature, or the desired rapid expansion force cannot be obtained even though the oxidation reaction occurs.

SUMMARY OF THE INVENTION

Therefore, it is an object of the present invention to alleviate the problems in the prior art and to provide a rapidly expanding metallic mixture treated for oxidation prevention thereof at room temperature, capable of preventing a metal powder in the metallic mixture from being oxidized by moisture or air at room temperature during storage.

DETAILED DESCRIPTION OF THE INVENTION

Based on the present invention, a rapidly expanding metallic mixture treated to prevent oxidation thereof at room temperature is characterized in that the metallic mixture of a metal salt and a metal powder is added with a water repellent such as oil, or an inorganic preservative.

The mixture of the metal salt and the metal powder is mixed at a weight ratio of 0.1:99.9–99.9:0.1 with the water repellent such as oil, or the inorganic preservative.

Said oil includes, but is not limited to, light oil, petroleum, paraffin oil, castor oil, and combinations thereof.

Alternatively, the mixture of the metal salt and the metal powder may be coated with a resin and formed to the size of 0.1–100 $mm^3$, thus achieving the object of the present invention.

Thereby, the metal powder which is exposed to air or moisture can be prevented from being oxidized during storage.

Below, a description will be given of the present invention.

As the above metal salt, metal nitrates are most preferable, but the invention is not limited thereto. In addition, the metal salts are exemplified by metal oxides, metal hydroxides, metal carbonates, metal sulfates and metal perchlorates. Such a metal salt may be used alone or in combinations thereof. In particular, the metal nitrates may be further added with at least one metal salt selected from among metal oxides, metal hydroxides, metal sulfates and metal perchlorates, to control the temperature required for initiation of oxidation and the time period required for oxidation.

The metal nitrates include, but are not limited to, ferrous nitrate ($Fe(NO_3)_2$), copper nitrate ($Cu(NO_3)_2$), barium nitrate ($Ba(NO_3)_2$), manganese nitrate ($Mn(NO_3)_4$), magnesium nitrate ($Mg(NO_3)_2$), potassium nitrate ($KNO_3$), sodium nitrate ($NaNO_3$), and calcium nitrate ($Ca(NO_3)_2$). The metal nitrates may be used alone or in combinations thereof.

The metal oxides include, but are not limited to, manganese oxide ($Mn_3O_4$), calcium oxide (CaO), titanium oxide ($TiO_2$), manganese dioxide ($MnO_2$), chromium oxide ($Cr_2O_3$), ferric oxide ($Fe_2O_3$), triiron tetroxide ($Fe_3O_4$), nickel oxide (NiO), copper oxide (CuO), zinc oxide (ZnO), potassium oxide ($K_2O$), sodium oxide ($Na_2O$), dinickel trioxide ($Ni_2O_3$), lead oxide (PbO), lithium oxide ($Li_2O$), barium oxide (BaO), strontium oxide (SrO), and boron oxide ($B_2O_3$). The metal oxides may be used alone or in combinations thereof.

The metal hydroxides include, but are not limited to, lithium hydroxide (LiOH), potassium hydroxide (KOH), sodium hydroxide (NaOH), calcium hydroxide ($Ca(OH)_2$), barium hydroxide ($Ba(OH)_2$), strontium hydroxide ($Sr(OH)_2$), zinc hydroxide ($Zn(OH)_2$), ferric hydroxide ($Fe(OH)_3$), copper hydroxide ($Cu(OH)_2$), nickel hydroxide ($Ni(OH)_2$), manganese hydroxide ($Mn(OH)_3$), chromium hydroxide ($Cr(OH)_3$), and magnesium hydroxide (MgOH). The metal hydroxides may be used alone or in combinations thereof.

The metal carbonates include, but are not limited to, lithium carbonate ($Li_2CO_3$), potassium carbonate ($K_2CO_3$), sodium carbonate ($Na_2CO_3$), calcium carbonate ($CaCO_3$), barium carbonate ($BaCO_3$), strontium carbonate ($SrCO_3$), zinc carbonate ($ZnCO_3$), ferrous carbonate ($FeCO_3$), copper carbonate ($CuCO_3$), nickel carbonate ($NiCO_3$), manganese carbonate ($MnCO_3$), chromium carbonate ($CrCO_3$), and magnesium carbonate ($MgCO_3$). The metal carbonates may be used alone or in combinations thereof.

The metal sulfates include, but are not limited to, potassium sulfate ($K_2SO_4$), lithium sulfate ($Li_2SO_4$), sodium sulfate ($Na_2SO_4$), calcium sulfate ($CaSO_4$), barium sulfate ($BaSO_4$), strontium sulfate ($SrSO_4$), zinc sulfate ($ZnSO_4$), ferrous sulfate ($FeSO_4$), copper sulfate ($CuSO_4$), nickel sulfate ($NiSO_4$), aluminum sulfate ($Al_2(SO_4)_3$), manganese sulfate ($MnSO_4$), magnesium sulfate ($MgSO_4$), and chromium sulfate ($CrSO_4$). The metal sulfates may be used alone or in combinations thereof.

The metal perchlorates include, but are not limited to, potassium perchlorate ($KClO_4$), lithium perchlorate ($LiClO_4$), sodium perchlorate ($NaClO_4$), calcium perchlorate ($Ca(ClO_4)_2$), barium perchlorate ($Ba(ClO_4)_2$), zinc perchlorate ($Zn(ClO_4)_2$), ferrous perchlorate ($Fe(ClO_4)_3$), manganese perchlorate ($Mn(ClO_4)_2$) magnesium perchloratee ($Mg(ClO_4)_2$), and combinations thereof.

The metal powder includes, but is not limited to, aluminum (Al) powder, sodium (Na) powder, potassium (K) powder, lithium (Li) powder, magnesium (Mg) powder, calcium (Ca) powder, manganese (Mn) powder, barium (Ba) powder, chromium (Cr) powder, and silicon (Si) powder. The metal powder may be used alone or in combinations thereof.

The expansion force of the rapidly expanding metallic mixture is determined depending on types and mixing ratios of the metal salt and the metal powder, in which the metal salt is mixed with the metal powder at a weight ratio of 0.1:99.9–99.9:0.1. The specific mixing ratio of the metal salt and the metal powder is defined by a ratio of the oxygen amount generated from the metal salt versus the oxygen amount required for oxidation of the metal powder.

The temperature required to trigger the oxidation of the metallic mixture of the metal salt and the metal powder is about 1,500° C. However, such temperature varies with types and mixing ratios of the metal salt. In any cases, a high temperature of 700° C. or more is required.

The oxidation of the metallic mixture comprising the metal salt and the metal powder is triggered by initial oxidation-triggering heat provided by electric spark or high temperature internal tubes. When the oxidation reaction is initiated, high temperature heat amounting to 3,000–30,000° C. or more is created, by which vaporization and rapid expansion of the reaction products occur.

The mixture of the metal salt and the metal powder is incorporated into an insulating outer casing made of paper tubes, plastic tubes or ceramic tubes, and is sealed at both ends, to prepare a capsule. As such, the water repellent such as oil or the inorganic preservative is introduced to the metallic mixture in the amount capable of coating the mixture, while maintaining the mixing weight ratio of 0.1:99.9–99.9:0.1 between the water repellent or the inorganic preservative and the metallic mixture.

Said oil is selected from among light oil, petroleum, paraffin oil, castor oil and combinations thereof, but it is not limited thereto. Any oil may be used, so long as the oil functions to prevent oxidation of the metal.

Alternatively, the mixture of the metal salt and the metal powder is coated with the resin and formed to the size of 0.1–100 $mm^3$, in which the resin is composed of synthetic rubbers and synthetic resins such as polyethylene (PE), polypropylene (PP), polyvinyl chloride (PVC), etc. In addition, silicones or natural resins having corrosion resistance may be used. The resin in the molten state is added to the metallic mixture of the metal salt and the metal powder, formed to a predetermined size and dried, followed by incorporating the resin-coated mixture into the insulating outer casing made of paper tubes, plastic tubes or ceramic tubes and sealing the casing at both ends, thereby preparing a capsule.

Hereinafter, oxidation reactions of the metal salt and the metal powder triggered at high temperatures are illustrated.

It is noted that, upon oxidation of the metal salt and the metal powder at high temperatures, because the added inorganic preservative, oil or resin is melted and vaporized at high temperature conditions, it does not affect oxidation of metal powder by the metal salt.

(1) When a mixture of ferrous nitrate ($Fe(NO_3)_2$) and manganese (Mn) powder is subjected to a thermal shock of about 1,500° C., the following reaction occurs:

Reaction 1

$$2Fe(NO_3)_2+12Mn \rightarrow 2FeO+4Mn_3O_4+3N_2$$

The oxidation reaction represented by the above Reaction 1 occurs in 1/2000 to 1/100 sec, in which very small amounts of nitrogen gas are generated. Upon the oxidation reaction of the above Reaction 1, oxidation heat reaching 10,000–30,000° C. is created, by which iron (Fe) and manganese oxide ($Mn_3O_4$) products are vaporized and rapidly expanded. The expansion force induced upon vapor expansion amounts to 40,000–60,000 kg/cm$^2$. During vaporization and rapid expansion, a reverse reaction of the above reaction does not occur. Increase of the volume of the reaction products due to rapid expansion leads to decrease of the internal temperature. As such, iron (Fe) and manganese oxide ($Mn_3O_4$) are changed from gaseous state to solid state, and expansion pressure disappears instantaneously. The phenomenon of temperature decrease due to rapid expansion can be explained according to Charles' Law related to volume and temperature, or the theory of adiabatic expansion.

(2) When a mixture of ferrous nitrate ($Fe(NO_3)_2$), copper oxide (CuO) and aluminum (Al) powder is subjected to a thermal shock of about 1,500° C., the following reaction occurs:

Reaction 2

$$Fe(NO_3)_2+3CuO+6Al \rightarrow Fe+3Cu+3Al_2O_3+N_2$$

The oxidation reaction represented by the above Reaction 2 occurs in 1/2,000 to 1/1,000 sec, in which very small amounts of nitrogen gas are generated. Upon the oxidation of the above Reaction 2, oxidation heat reaching 10,000–30,000° C. is created, by which iron (Fe), copper (Cu) and aluminum oxide ($Al_2O_3$) products are vaporized and rapidly expanded. The expansion force induced upon vapor expansion amounts to 40,000–60,000 kg/cm$^2$. During vaporization and rapid expansion, a reverse reaction of the above reaction does not occur. Increase of the volume of the reaction products due to rapid expansion leads to decrease of the internal temperature. As such, iron (Fe), copper (Cu) and aluminum oxide ($Al_2O_3$) are changed in state from gas to solid, and expansion pressure disappears instantaneously. The phenomenon of temperature decrease due to rapid expansion can be explained according to Charles' Law related to volume and temperature, or the theory of adiabatic expansion.

(3) When a mixture comprising calcium nitrate ($Ca(NO_3)_2$), triiron tetroxide ($Fe_3O_4$) and aluminum (Al) powder is subjected to a thermal shock of about 1,500° C., the following reaction occurs:

Reaction 3

$$3Ca(NO_3)_2+2Fe_3O_4+12Al \rightarrow 2CaO+6Fe+6Al_2O_3+2N_2$$

The oxidation reaction represented by the above Reaction 3 occurs in 1/1,000 to 1/500 sec, in which very small amounts of nitrogen gas are generated. Upon the oxidation of the above Reaction 3, oxidation heat reaching 10,000–30,000° C. is created, by which calcium oxide (CaO), iron (Fe) and aluminum oxide ($Al_2O_3$) products are vaporized and rapidly expanded. The expansion force induced upon vapor expansion amounts to 40,000–60,000 kg/cm$^2$. During vaporization and rapid expansion, a reverse reaction of the above reaction does not occur. Increase of the volume of the reaction products due to rapid expansion results in decrease of the internal temperature. As such, calcium oxide (CaO), iron (Fe) and aluminum oxide ($Al_2O_3$) are changed in state from gas to solid, and expansion pressure disappears instantaneously. The phenomenon of temperature decrease due to rapid expansion can be explained according to Charles' Law related to volume and temperature, or the theory of adiabatic expansion.

Below, oxidation reactions are illustrated using other metal salts, in place of nitrates.

(4) When a mixture comprising ferric oxide ($Fe_2O_3$), sodium oxide ($Na_2O$), barium carbonate ($BaCO_3$) and magnesium (Mg) powder is subjected to a thermal shock of about 1,500° C., the following reaction occurs:

Reaction 4

$$Fe_2O_3+4Na_2O+BaCO_3+4Mg \rightarrow 4Na_2MgO_2+2Fe+Ba+CO_2$$

The oxidation reaction represented by the above Reaction 4 occurs in 1/2,000 to 1/1,000 sec, in which very small amounts of carbon dioxide ($CO_2$) gas are generated. Upon the oxidation reaction of the above Reaction 4, oxidation heat reaching 7,000 to 30,000° C. is created, by which sodium magnesium oxide ($Na_2MgO_2$), iron (Fe) and barium (Ba) products are vaporized and rapidly expanded. The expansion force induced upon vapor expansion amounts to 40,000–55,000 kg/cm$^2$. During vaporization and rapid expansion, a reverse reaction of the above reaction does not occur. When the volume of the reaction products increases due to rapid expansion, the internal temperature decreases. As such, sodium magnesium oxide ($Na_2MgO_2$), iron (Fe) and barium (Ba) are changed from gaseous state to solid state, and expansion force disappears instantaneously. The phenomenon of temperature decrease due to rapid expansion can be explained according to Charles' Law related to volume and temperature, or the theory of adiabatic expansion.

(5) When a mixture comprising ferric oxide ($Fe_2O_3$), zinc oxide (ZnO), sodium sulfate ($NaSO_4$) and aluminum (Al) powder is subjected to a thermal shock of about 1,500° C., the following reaction occurs:

Reaction 5

$$Fe_2O_3+NaSO_4+4Al \rightarrow Na_2Al_4O_7+2FeO+Zn+S$$

The oxidation reaction represented by the above Reaction 5 occurs in 1/2,000 to 1/1,000 sec, in which very small amounts of sulfur (S) gas are generated. Upon the oxidation reaction of the above Reaction 5, oxidation heat reaching 7,000 to 30,000° C. is created, by which sodium aluminum oxide ($Na_2Al_4O_7$), ferrous oxide (FeO) and zinc (Zn) products are vaporized and rapidly expanded. The expansion force induced upon vapor expansion amounts to 40,000–55,000 kg/cm$^2$. During vaporization and rapid expansion, a reverse reaction of the above reaction does not occur. When the volume of the reaction products increases due to rapid expansion, the internal temperature decreases. As such, sodium aluminum oxide ($Na_2Al_4O_7$), ferrous oxide (FeO) and zinc (Zn) are changed from gaseous state to solid state, and expansion pressure disappears instantaneously. The phenomenon of temperature decrease due to rapid expansion can be explained according to Charles' Law related to volume and temperature or the theory of adiabatic expansion.

(6) When a mixture comprising ferric oxide ($Fe_2O_3$), sodium oxide ($Na_2O$), copper oxide (CuO) and aluminum (Al) powder is subjected to a thermal shock of about 1,500° C., the following reaction occurs:

Reaction 6

$$2Na_2O+Fe_2O_3+3CuO+2Al \rightarrow Na_2Al_2O_4+Na_2Fe_2O_4+3Cu$$

The oxidation reaction represented by the above Reaction 6 occurs in 1/2,000 to 1/1,000 sec. In the above Reaction 6, oxidation heat reaching 7,000 to 30,000° C. is created, by which sodium aluminum oxide ($Na_2Al_2O_4$), sodium iron oxide ($Na_2Fe_2O_4$) and copper (Cu) products are vaporized and rapidly expanded. The expansion force induced upon vapor expansion amounts to 40,000–60,000 kg/cm$^2$. During vaporization and rapid expansion, a reverse reaction of the above reaction does not occur. When the volume of the reaction products increases due to rapid expansion, the internal temperature decreases. As such, sodium aluminum oxide ($Na_2Al_2O_4$), sodium iron oxide ($Na_2Fe_2O_4$) and copper (Cu) are changed from gaseous state to solid state, and expansion pressure disappears instantaneously. The phenomenon of temperature decrease due to rapid expansion can be explained according to a Charles' Law related to volume and temperature or the theory of adiabatic expansion.

(7) When a mixture comprising sodium perchlorate ($NaClO_4$), copper oxide (CuO) and aluminum (Al) powder is subjected to a thermal shock of about 1,500° C., the following reaction occurs:

Reaction 7

$$NaClO_4+2CuO+2Al \rightarrow NaCl+Al_2O_3+Cu$$

The oxidation reaction represented by the above Reaction 7 occurs in 1/2,000 to 1/1,000 sec. In the above Reaction 7, oxidation heat reaching 7,000 to 30,000° C. is created, by which aluminum oxide ($Al_2O_3$), sodium chloride (NaCl) and copper (Cu) products are vaporized and rapidly expanded. The expansion force induced upon vapor expansion amounts to 40,000–60,000 kg/cm$^2$. During vaporization and rapid expansion, a reverse reaction of the above reaction does not occur. When the volume of the reaction products increases due to rapid expansion, the internal temperature decreases. As such, aluminum oxide ($Al_2O_3$), sodium chloride (NaCl) and copper (Cu) are changed from gaseous state to solid state, and expansion pressure disappears instantaneously. The phenomenon of temperature decrease due to rapid expansion can be explained according to a Charles' Law related to volume and temperature or the theory of adiabatic expansion.

Thus, the added oil, the inorganic preservative, or the coated resin can function to prevent the metal powder from being oxidized by moisture or air at room temperature. However, upon the oxidation reaction of the metal salt and the metal powder triggered at a high temperature, the added oil, the inorganic preservative, or the coated resin has no influence on oxidation of the metal powder by the metal salt since it is melted and vaporized under such high temperature conditions.

According to the present invention, the rapidly expanding metallic mixture, capable of blasting the target material without scattering of broken fragments, or generating any explosive sound or vibration, can be stored at room temperature, without any oxidation reaction occurring. Therefore, even though stored for a long-term period, the metallic mixture is not accidentally exploded, or the triggering temperature and expansion force intended upon preparation can be maintained.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

What is claimed is:

1. A metallic mixture, capable of rapidly expanding upon being heated to at least 700° C. being treated to prevent oxidation thereof at room temperature, comprising a metal salt and a metal powder, wherein the metallic mixture is coated with a water repellent including oil or an inorganic preservative.

2. The metallic mixture as set forth in claim 1, wherein the metallic mixture of the metal salt and the metal powder is mixed with oil or the inorganic preservative at a weight ratio of 0.1:99.9–99.9:0.1.

3. The metallic mixture as set forth in claim 1, wherein said oil is selected from among light oil, petroleum, paraffin oil, castor oil and combinations thereof.

4. A water-free oil/inorganic preservative coated metallic mixture, comprising:

a metal salt; and a metal powder, wherein the metallic mixture is capable of rapidly expanding upon being heated to at least 700° C.

* * * * *